United States Patent [19]

Ramer

[11] 4,157,191

[45] Jun. 5, 1979

[54] SKI BINDING

[76] Inventor: Paul C. Ramer, Rte. 4, Box 344, Golden, Colo. 80401

[21] Appl. No.: 854,595

[22] Filed: Nov. 25, 1977

[51] Int. Cl.[2] ..... A63C 9/08

[52] U.S. Cl. ..... 280/614; 280/618; 280/620; 280/633

[58] Field of Search ..... 280/614, 615, 618, 633, 280/617, 623, 631, 632, 619, 620

[56] References Cited

U.S. PATENT DOCUMENTS

| | | | |
|---|---|---|---|
| 2,072,477 | 3/1937 | Dodd | 280/614 |
| 2,682,416 | 6/1954 | Knauf | 280/627 |
| 3,244,431 | 4/1966 | Hatlapa | 280/614 |
| 3,905,613 | 9/1975 | Romeo | 280/623 |
| 3,918,732 | 11/1975 | Wulf | 280/613 X |
| 3,944,237 | 3/1976 | Teague, Jr. | 280/618 |
| 3,975,033 | 8/1976 | Lill et al. | 280/618 |
| 4,002,354 | 1/1977 | Ramer | 280/614 |

FOREIGN PATENT DOCUMENTS

| | | | |
|---|---|---|---|
| 1110856 | 2/1956 | France | 280/619 |

*Primary Examiner*—Joseph F. Peters, Jr.
*Assistant Examiner*—Milton L. Smith

[57] ABSTRACT

A toe piece release mechanism, a mechanism for accommodating various sized boots, and an over-center latch lever for holding the heel of a ski boot to a ski are incorporated into a release binding. The toe piece release mechanism includes a vertically extending groove formed in a downward portion of a release socket into which the end of a longitudinally extending pin is releasably received. The vertically extending groove facilitates vertical release movement of the socket with respect to the pin for achieving better conditions of vertical toe release or longitudinal torsion release. The adjustment mechanism for accommodating different lengths of ski boots includes a carriage member which operatively positions a heel retaining device on the ski boot. The carriage member is selectively positioned longitudinally along the ski or a boot plate member by insertion of fastening means through one of a plurality of spaced apertures in the carriage member and through one of a plurality of apertures spaced at different intervals in the boot plate member. The over-center latch lever member includes transversely extending stop means for contacting a rigid bail member when the latch lever pivots on the bail to a predetermined point past the over-center position. These features are adaptable to a ski binding which can be used in both alpine skiing and cross-country skiing and which can be quickly converted for use in either type of skiing.

5 Claims, 10 Drawing Figures

Fig-3
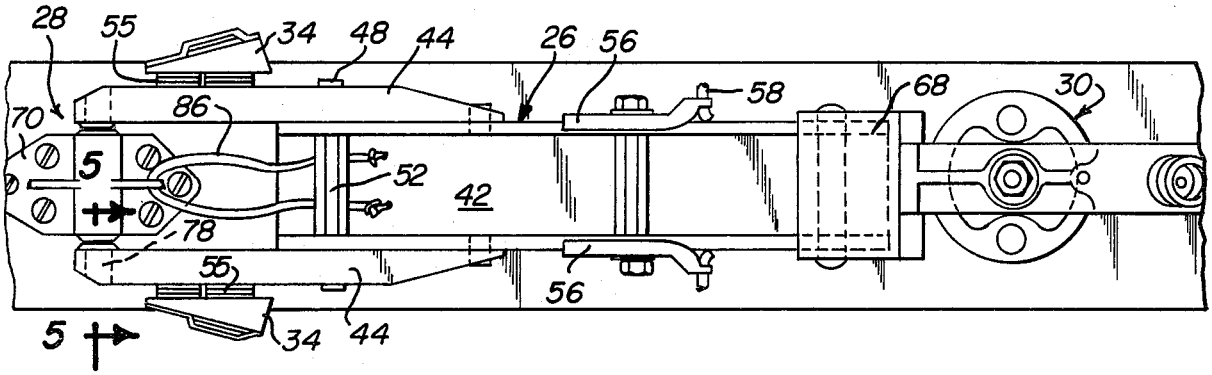
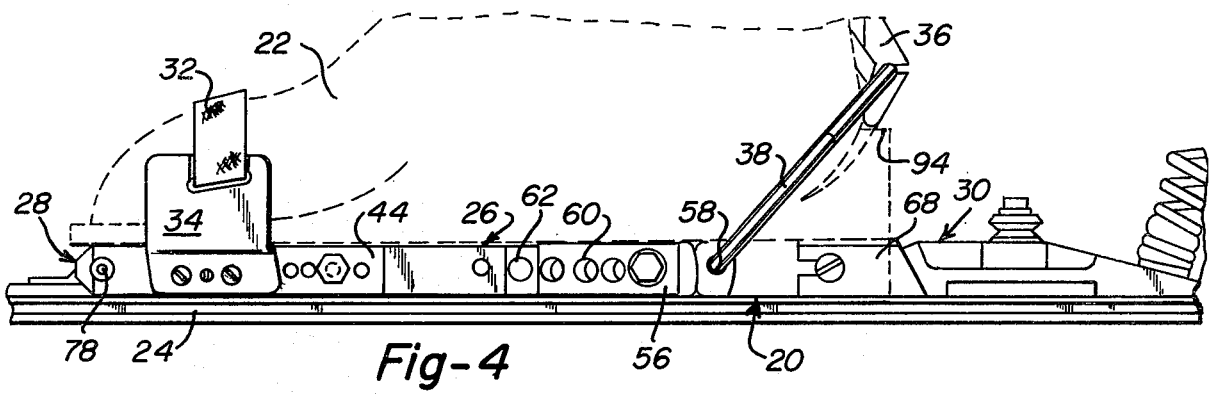
Fig-4
Fig-6
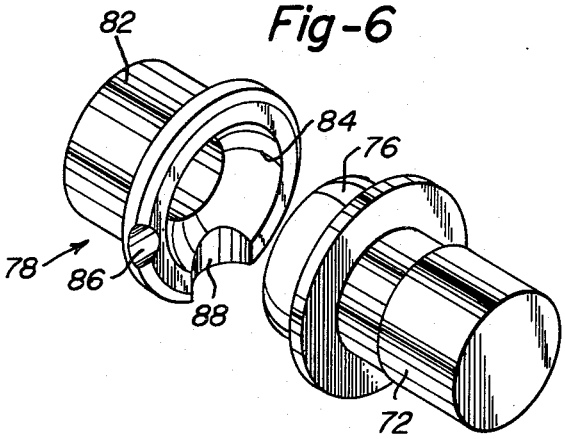
Fig-5
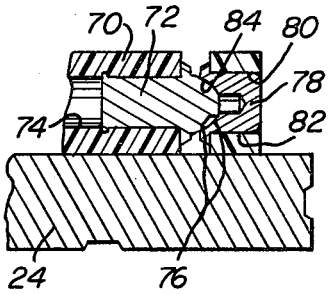
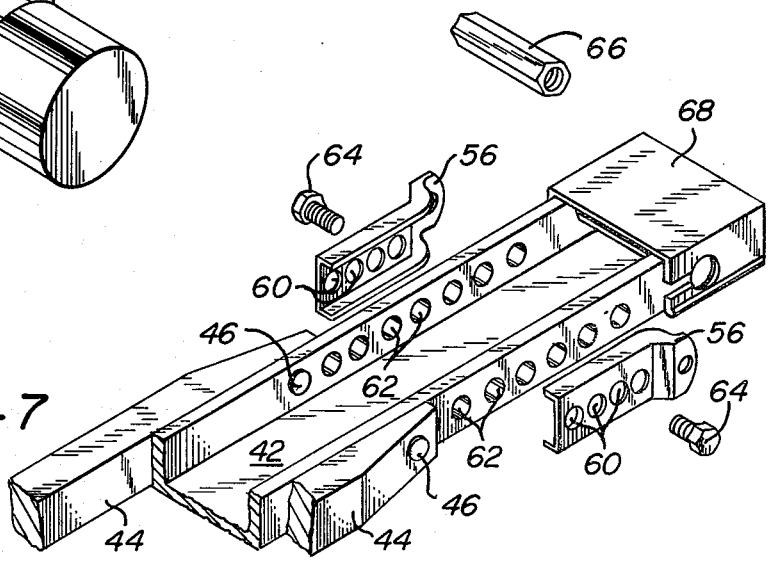
Fig-7

SKI BINDING

BACKGROUND OF THE INVENTION

1. Field of the Invention

This invention relates to improvements in a release binding for releasably securing a ski boot to a snow ski.

2. Brief Description of Prior Art

There are two general types of snow skiing: alpine or downhill skiing and nordic or cross-country skiing. The operation of ski bindings for binding the skier's boot to the skis is different for alpine skiing than for nordic skiing, and it is typical that a binding used for alpine skiing is not usable for nordic skiing. This is because the movement involved in nordic skiing requires a pivoting of the ski boot at its toe while alpine skiing requires the boot to be firmly and releasably retained to the ski. However, U.S. Pat. No. 4,002,354 to Paul C. Ramer describes a ski binding which can be satisfactorily used for either alpine or nordic skiing. The present invention relates to improvements in a ski binding which can be advantageously employed with a binding of the type described in the aforementioned patent to Ramer or with various other types of ski bindings.

Release bindings used in alpine skiing are intended to release the ski boot from the ski upon the application of a potentially dangerous amount of force to the skier's leg and foot. Avoidance of injury depends upon the consistent and proper release of the safety binding. It has recently been determined that ski bindings which provide a vertical toe release or a longitudinal torsion release (relative rotation of the ski about its longitudinal axis with respect to the ski boot) can be instrumental in preventing injury in some situations. Many of the prior art bindings do not release under these conditions. The present invention teaches improvements for securing more effective vertical toe release and longitudinal torsion release.

Another problem with prior art release bindings is that the ski boot is not always firmly retained on the ski or a boot plate. This problem is particularly significant if the ski bindings are continually adjusted to accommodate a variety of different sized and shaped ski boots. One of the causes of this inadequate fastening has been that the binding cannot be accurately adjusted to accept ski boots of different lengths. The present invention teaches improvements for quickly, easily and accurately adjusting the ski binding to accommodate and firmly retain ski boots of a variety of different lengths.

Some prior art ski bindings, particularly those of the boot plate type, employ an over-center latch lever pivotably connected to a bail for operatively securing the heel of the ski boot to the ski. The latch lever is pivoted to an over-center condition against a ledge formed on the ski boot heel, and biases the boot heel downward in tight engagement with the boot plate or the ski. In its proper over-center condition, a biasing force from the latch lever holds the ski boot to the ski, but if the latch lever pivots past its desired over-center condition, the biasing force diminishes or terminates thus loosening the boot. It has been found that the heel construction of certain ski boots allows the latch lever to pivot past a desired over-center position. The present invention teaches improvements for preventing the latch lever from pivoting past its desired over-center condition.

Various other disadvantages, problems, insufficiencies and considerations are present in the prior art, and in general, these factors will become more apparent from an understanding of the teachings and improvements of the present invention and its advantages and objects.

SUMMARY OF THE INVENTION

The invention can be generally appreciated from its objects, which are to provide a new and improved ski binding of a character which assures a reliable vertical toe release and longitudinal torsion release, which allows easy, quick and accurate adjustment of the ski binding to accommodate and securely retain ski boots of different lengths, and which prevents the latch lever from pivoting past its desired over-center position thereby maintaining the ski boot heel firmly retained on the ski. Another object of this invention is to provide the aforementioned features and improvements in a ski binding adapted for selective use in both alpine and nordic skiing.

In accordance with the aforenoted aspects of the invention, an improved toe piece of the ski binding comprises laterally extending pin means received within a release socket means, and a vertical groove means is formed in the release socket means for facilitating vertical separation of the pin means from the release socket means. The ski binding includes, in accordance with other aspects of the invention, an improved means for releasably securing a variety of different lengths of ski boots to the ski or a boot plate member. The boot plate or other device attached to the ski includes a main body member, and a carriage member is connected to the main body member by fastening means. The carriage member operatively positions the heel retaining means at the heel of the ski boot. A plurality of apertures are formed in spaced-apart relation in the main body of the boot plate and a plurality of apertures are formed in the carriage member in a spaced-apart relation which is different from the spaced-apart relation between the apertures in the main body member. Due to the difference in spacing in the apertures in the main body and the carriage member, selecting different apertures through which the fastening means extends provides accurate adjustment for different lengths of ski boots. The heel retaining means attached to the carriage member may comprise, in accordance with another aspect of the invention, an over-center latch lever member operatively connected to pivot about a rigid extension bail member, and stop means are associated with the over-center latch for contacting the rigid bail member upon the latch lever pivoting to a desired over-center condition to prevent release of or reduction in the bias force against the heel of the boot.

A more complete understanding of the invention can be obtained from the appended claims which specifically define the invention, and from a description of a presently preferred embodiment of the invention which is shown in a drawing consisting of various figures.

BRIEF DESCRIPTION OF THE DRAWINGS

FIG. 3 is a top plan view of the ski binding illustrated in FIG. 1 mounted on a ski, with a portion of the ski binding removed for clarity.

FIG. 4 is a side elevational view of FIG. 1.

FIG. 5 is a vertical sectional view taken substantially in the plane of line 5—5 of FIG. 3.

FIG. 6 is an enlarged perspective view of a portion of a toe piece of the ski binding illustrated in FIG. 1, which is designated herein as a release socket.

FIG. 7 is a perspective view of a portion of the boot plate member with certain elements thereof shown in exploded relationship. These exploded elements illustrate one embodiment of an improved feature of the invention for accommodating ski boots of various lengths.

DESCRIPTION OF PREFERRED EMBODIMENT

Figure 1:
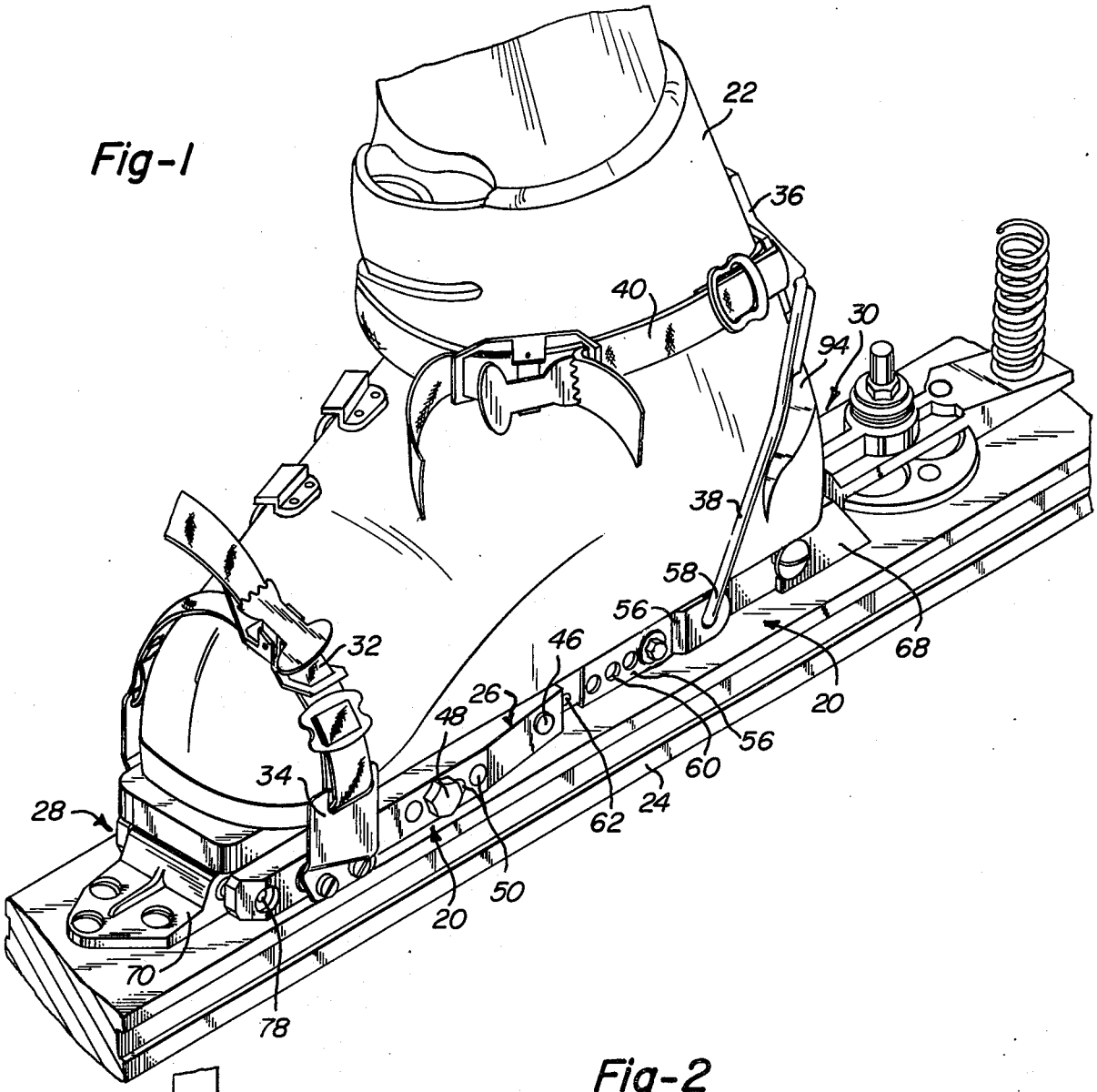
FIG. 1 is a perspective view of a new and improved ski binding according to the present invention illustrated in a condition of releasably securing a ski boot to a ski.

A ski binding 20 in which the present invention has been incorporated is illustrated in FIGS. 1 and 4 as operatively connecting a ski boot 22 to a ski 24. The ski binding 20 comprises a boot plate member 26, a toe piece 28 and a heel piece 30. The toe piece 28 and heel piece 30 are rigidly connected to the ski 24 by conventional fastening means and retain the boot plate member 26 intermediate thereof. The toe of the ski boot 22 is securely attached to the boot plate member 26 by an adjustable strap 32 looped over the boot toe and extending between brackets 34 attached to the forward end of the boot plate member 26. The heel of the ski boot is biased downwardly in tight engagement with the boot plate 26 by heel retaining means comprising an over-center latch lever member 36 pivotably connected to a rigid U-shaped bail member 38 extending from opposite lateral sides of the boot plate member 26 around the heel of the ski boot 22. A safety strap 40 extends from the latch lever member 36 around the ankle of the ski boot 22 to prevent inadvertent disassociation of the boot plate 26 from the boot.

The ski binding 20 is of a type which may be selectively and interchangeably used for either alpine skiing or nordic skiing. The toe piece 28 has features which allow the toe of the ski boot to pivot for nordic skiing and to be releasably fixed as a safety binding for alpine skiing. The heel piece 30 allows the heel of the ski boot to pivot upward and forwardly for nordic skiing in one condition of operation, and in the other condition of operation, allows the heel of the ski boot to be releasably secured to the ski. These and other features of the ski binding 20 are more fully described in U.S. Pat. No. 4,002,354 to Paul C. Ramer, the inventor herein, and the disclosure of this patent to Ramer is hereby incorporated by reference. It should be understood that the present invention can be applied to ski bindings of various other types, as would be apparent to one skilled in the art.

Figure 2:
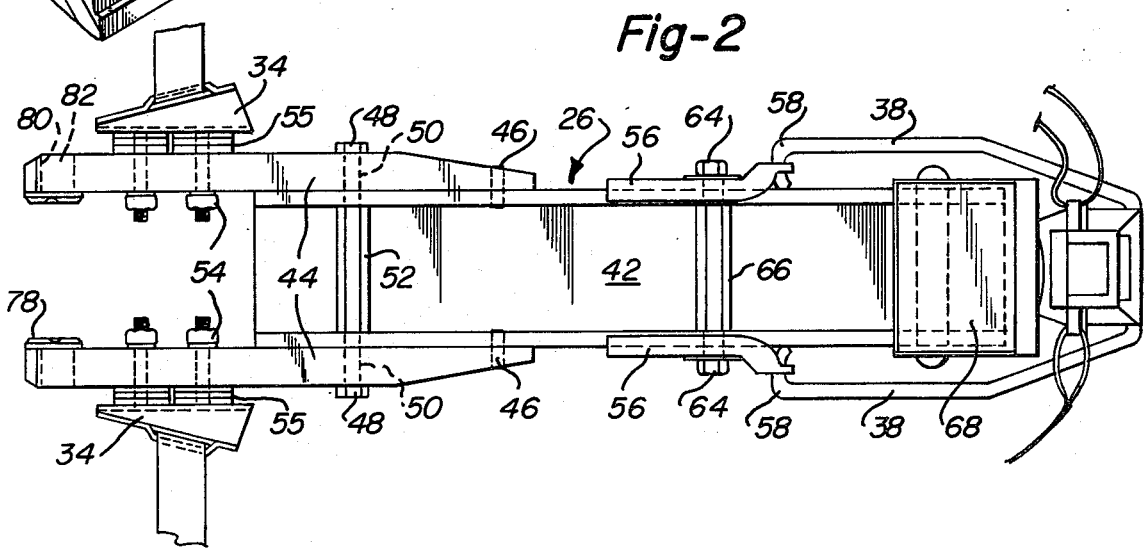
FIG. 2 is a top plan view of a portion of the ski binding illustrated in FIG. 1, which includes elements designated herein as a boot plate member and heel retaining means.

The boot plate member, shown best in FIGS. 2 and 3, comprises a main body member 42 of U-shaped construction opening upward from the ski. A pair of spring bar members 44 are attached on opposite lateral sides of the main body 42 and protrude forwardly therefrom a selected distance. The spring bar members 44 are retained in position by fastening means such as rivets 46 at the rearward end thereof and by screw-type fastener means 48 extending through apertures 50 into a barrel nut 52. The brackets 34 retaining the toe strap 32 are attached to the spring bars 44 by conventional fastening means 54 such as bolts and nuts. A plurality of washers 55 position the brackets 34 to accommodate different widths of ski boots 22.

The over-center latch lever member 36 and bail member 38 are connected to the main body 42 by carriage members 56 to which the terminal ends 58 of the bail member 38 are pivotably connected. As is best shown in FIG. 7, a plurality of apertures 60 are formed in a row in each carriage member 56, and a plurality of apertures 62 are formed in a row in the upstanding portions of the U-shaped main body member 42. A screw-type fastener 64 extends through one of each of the apertures 62 and 64 and is threaded into a barrel nut 66 to retain one carriage member 56 on each laterally opposite side of the main body member 42.

An end cap member 68 terminates the rearward end of the main body 42 of the boot plate member 26. The heel piece 30 cooperates with the end cap 68 to retain the rearward end of the boot plate member in a releasably secured fashion to the ski for alpine skiing, and to allow the rearward end of the boot plate member 26 to pivot about its forward end for nordic skiing. The end cap member 68 and the heel piece 30, along with their associated elements and method of operation are more fully described in the aforementioned patent to Ramer.

An improved toe piece 28 of the ski binding 20 is shown best in FIGS. 1, 3, 5 and 6. A toe piece mounting bracket 70 is attached to the ski 24 and pin means 72 project laterally outward from an opening 74 which extends laterally through the bracket 70. The outward ends 76 of the pin means 70 form a convexly-shaped, outward-protruding, cammed surface. Release sockets 78 are received in apertures 80 in the forward ends of the spring bar members 44 by press fitting a shank 82 of the release socket 78 into the aperture 80. A concavely-shaped, indented cam surface 84 receives the cammed surface end 76 of the pin means 72 to obtain an operative association. A reentry groove 86 is provided in the forward end of the indented surface 74 for facilitating the positioning of the pin means ends 76 within the indented surface 84 of the release sockets. A vertical release groove 88 is formed in a vertically or upwardly extending manner in the bottom portion of the indented surface 84 to facilitate vertical toe release or lateral torsion release as will be more fully described. A safety cord 86 extends from the toe piece mounting bracket 70 to the barrel nut 52 of the boot plate member 26 to prevent a runaway ski should the boot plate member 26 release from the toe and heel pieces 28 and 30, respectively.

As described more particularly in the aforementioned patent to Ramer, each spring bar 44 is made of semi-rigid metal, and the forward ends of the spring bar members are adapted to flex laterally outwardly and release the pin means ends 76 from the release socket indented surface 84 upon the application of a preselected force. The amount of force to obtain release is determined primarily by the location of the screw-type fastener means 48 through the spring bar members 44. Positioning the fastening means 48 at the forward end of the apertures formed through the spring member 44 and main body member 42 increases the amount of force required to separate and release the toe piece, and conversely, positioning the fastener means 48 at the rear of the apertures decreases the amount of force required to separate and release the toe piece. Upon separation, cammed end 76 of the pin means 72 is released from the indented surface 84 of the release socket 78 on one or both lateral sides of the toe piece, due to the relative lateral flex or movement of the spring bar members with respect to the pin means. Since the vertically extending groove 88 extends substantially through a significant portion of the indented surface 84 of the release socket 78, less outward flexing of the spring bar members 44, and hence less force, is required to separate the pin means end 76 from the indented surface 84 as the end 76 slides out of the groove 88. Thus, the vertical groove 88 facilitates relative vertical release of the pin means from the release socket and secures a reliable vertical toe release and lateral torsional release of the ski.

Improved means for accommodating various different lengths of ski boots is best illustrated in FIG. 7. The apertures 60 formed in the carriage member 56 are preferably spaced at equal intervals in the row. The apertures 62 formed in the upstanding side portions of the main body member 42 are preferably spaced at equal intervals in the longitudinally extending row. The intervals at which the apertures 60 are formed are different from the intervals between the apertures 62. For example, the apertures 60 may be formed at intervals of 0.3 inch while the apertures 62 may be formed at intervals of 0.4 inch. By forming the apertures at different intervals, selection of one aperture 60 and one aperture 62 through which each fastener means 64 extends adjusts position of the carriage member 56 on the main body member 42 and, as a result, the length of the bail member 38 and latch lever member 36 from the forward end of the boot plate member 26. For example, when apertures 60 are spaced at intervals of 0.3 inch and apertures 62 are spaced at intervals of 0.4 inch, adjustability in 0.1 inch increments is provided. The increment of adjustability is thus determined by the length difference between the interval of apertures 60 and the interval of apertures 62. The number of apertures 62 formed in the carriage member 56 should accommodate a full range of adjustability in increments desired. In the example given, at least four apertures are provided in each carriage member 56. The number of apertures 60 formed in the main body member 42 depends on the overall range of ski boot lengths which are to be accommodated.

Figure 8:
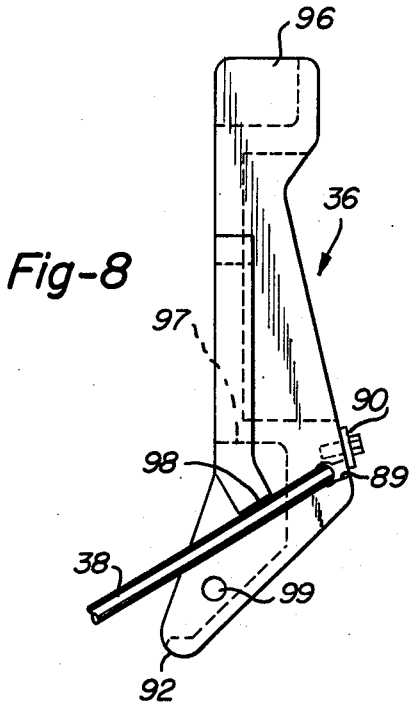
FIG. 8 is a side elevational view of a portion of a boot - heel retaining means of the ski binding illustrated in FIG. 1, which includes a latch lever member.
Figure 9:
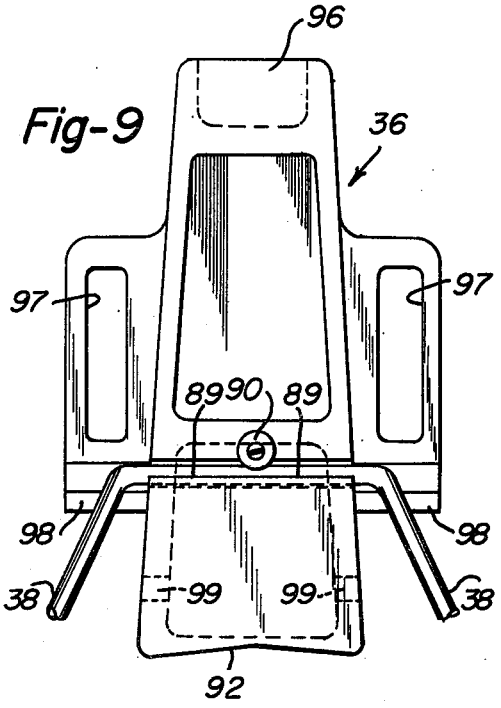
FIG. 9 is an end elevational view of FIG. 8.
Figure 10:
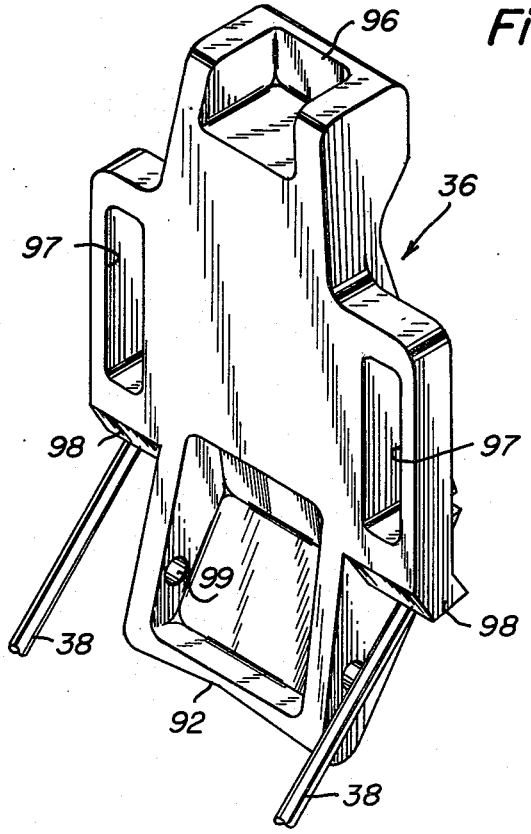
FIG. 10 is a perspective view of FIGS. 8 and 9.

Improvements for preventing the over-center latch lever member 36 from pivoting past a desired over-center condition to prevent slight release of the bias force on the heel of the ski boot can be better understood by reference to FIGS. 8, 9 and 10. The latch lever member 36 is pivotably connected to the rigid bail member 38. A groove 89 is formed laterally in the latch lever 36 and the groove 89 receives a transverse portion of the bail member 38. A fastening means in the form of a screw and washer 90 prevents separation of the bail member from the groove 89. The lower end 92 of the lever 36 contacts a laterally extending ledge 94 (FIGS. 1 and 4) formed at the heel of a ski boot. Prior to attaching the ski boot 22 to the boot plate 26, the lever member 36 is pivoted to a horizontal condition with the lower end 92 forward and the upper gripping end 96 in a rearward position. The lower end 92 is then positioned on the ledge 94 of the ski boot and the upper end 96 is pivoted forward until the latch lever member attains a nearly vertical and desired over-center position. As the latch lever pivots to the over-center position, downward bias is applied to the heel of the ski boot to operatively retain it to the ski. Typically, the latch lever member 36 contacts the rear portion of the ski boot to prevent it from pivoting past the desired over-center position. However, the construction of some ski boots allows the latch lever member to pivot farther forward than desired, past the desired over-center position. To prevent the lever member 36 from pivoting forward past its desired position and reducing the amount of bias force, stop means in the form of laterally extending rigid abutment members 98 contact the rigid bail member 38 upon pivoting of the latch lever to the desired overcenter position. The abutment members 98 are preferably formed as an integral part of the lever member 36. Openings 97 are formed in the integral abutment means for receiving the safety strap 40 therethrough. As a result of the abutment members 98, the lever member 36 is prevented from further pivoting forward, as could be allowed if the rear portion of the ski boot slopes sufficiently forward from the ledge 94 to allow such movement. As a result of the stop means, proper heel bias force is supplied without dependence on the ski boot construction.

To prevent the inadvertent rearward pivoting of the latch lever member, an aperture 99 is formed near the lower end 92 of the latch member to receive a transversely extending insert (not shown). The aperture 99 is positioned on the opposite side of the bail member 36 from the abutment members 98, when the latch lever is positioned in its desired over-center condition. With the insert inserted in aperture 99 and extending past the rigid bail member 38, the latch lever is prevented from pivoting rearward (clockwise as shown in FIG. 8) by the contact of the insert with the bail member 38. To release the latch lever member 36, the insert must be removed from aperture 99.

It is apparent from the foregoing description that the vertically extending groove 88 formed in the concave indented surface 84 of each release socket 78 facilitates a vertical toe release or lateral torsion release and secures more desirable release characteristics primarily for alpine skiing situations. The difference in interval spacing of the apertures 60 and 62 in the carriage member 56 and main body member 42, respectively, allows quick, rapid and accurate adjustment for ski boots of a variety of different lengths. The abutment members 98 of the latch lever member 36 prevent a decrease in bias force on the heel of the ski boot. These factors and others cooperate to provide a new and improved ski binding.

Although the present invention has been described with a certain degree of particularity, it is understood that the present disclosure has been made by way of example and that changes in detail of the structure may be made without departing from the spirit of the invention.

I claim as my invention:

1. A ski binding for releasably connecting a ski boot to a ski comprising, in combination:

a toe piece mounted on said ski and including laterally extending pin means having a cam surface on an end thereof;

a boot plate member connectable to the ski boot and having a main body portion, said main body portion including connection means at a forward end thereof adjacent the toe of the ski boot for releasably connecting with the pin means of said toe piece, said connection means including a release socket for receiving the end of said pin means, said pin means and said connection means being cooperatively operable for movement with respect to one another to release said pin means from said release socket, said release socket having a groove formed therein extending generally perpendicularly relative to the ski, said groove in said release socket facilitating upward relative separation of the end of said pin means from the release socket of said connection means; and a heel piece mounted on said ski operatively associated with said boot plate member so as to be selectively capable of holding the heel of the boot plate member adjacent the ski.

2. A ski binding as recited in claim 1 wherein the release socket is generally defined by an indented surface and said groove is formed in the indented surface.

3. A ski binding as recited in claim 2 wherein said connecting means of said boot plate member includes semi-rigid elongated member means connected to said boot plate member and extending longitudinally thereof for flexing laterally upon release of said pin means from said release socket, said release socket being positioned at the forward end of said member means.

4. A ski binding as recited in claim 3 wherein said boot plate member includes means for releasably securing the heel of the ski boot to the boot plate member, said means for releasably securing the heel of the ski boot comprising:

at least two spaced-apart apertures formed in a longitudinally extending row in said boot plate member, a carriage member having at least two spaced-apart apertures formed therein, the spacing between apertures in said carriage member being different than the spacing between the apertures in said boot plate member, fastening means extending through an aperture in said carriage member and through an aperture in said boot plate member for fastening said carriage member to said boot plate member, and retaining means operatively connected to said carriage means for holding the ski boot heel in operative engagement with said boot plate member.

5. A ski binding as recited in claim 4 wherein said retaining means comprises:

a bail-like extension member operatively connected at an end thereof to said carriage member, an overcenter latch lever member operatively connected to said extension member for pivoting against an end of said ski boot to an over-center condition for biasing the ski boot downward, and stop means associated with said latch lever member for contacting said extension member to resist further pivoting of said latch lever member past a predetermined over-center condition.

* * * * *